US010196827B2

(12) United States Patent
Cipriani

(10) Patent No.: US 10,196,827 B2
(45) Date of Patent: Feb. 5, 2019

(54) SUPPORTING SYSTEM FOR ABOVE-GROUND FLOORING

(71) Applicant: DAKOTA GROUP S.A.S. DI ZENO CIPRIANI & C., Affi (VR) (IT)

(72) Inventor: Zeno Cipriani, Milan (IT)

(73) Assignee: DAKOTA GROUP S.A.S. DI ZENO CIPRIANI & C., Affi (IT)

( * ) Notice: Subject to any disclaimer, the term of this patent is extended or adjusted under 35 U.S.C. 154(b) by 0 days.

(21) Appl. No.: 15/572,854

(22) PCT Filed: May 11, 2016

(86) PCT No.: PCT/IB2016/052704

§ 371 (c)(1),
(2) Date: Nov. 9, 2017

(87) PCT Pub. No.: WO2016/181328

PCT Pub. Date: Nov. 17, 2016

(65) Prior Publication Data

US 2018/0135311 A1 May 17, 2018

(30) Foreign Application Priority Data

May 12, 2015 (IT) ..... VR2015A0079

(51) Int. Cl.
*E04F 15/02* (2006.01)
*E04F 15/024* (2006.01)

(52) U.S. Cl.
CPC .... *E04F 15/0247* (2013.01); *E04F 15/02405* (2013.01); *E04F 15/02452* (2013.01)

(58) Field of Classification Search
CPC ..... E04F 15/0247; E04F 15/02452; E04F 15/02405; E04F 15/02464; E04B 1/003; E04B 5/43; E04C 2/38; E04C 2/40; E04C 2/42
See application file for complete search history.

(56) References Cited

U.S. PATENT DOCUMENTS 4,736,555 A * 4/1988 Nagare ..... E04F 15/02452 248/544
5,479,745 A * 1/1996 Kawai ..... E04F 15/02464 52/126.1
9,631,385 B1 * 4/2017 Phillips ..... E04H 3/24
(Continued)

FOREIGN PATENT DOCUMENTS

EP 0257237 A2 3/1988

OTHER PUBLICATIONS

International Search Report, dated Sep. 7, 2016, from corresponding PCT/IB2016/052704 application.

*Primary Examiner* — Patrick J Maestri
(74) *Attorney, Agent, or Firm* — Young & Thompson

(57) ABSTRACT

Disclosed is a supporting system for tiles to obtain floorings raised with respect to a reference ground. The supporting system includes a grid having at least three sides defining the perimeter of the grid and a supporting surface on which the tile can rest. At least one first seat is formed within the perimeter of the grid and at least one second seat is formed along the perimeter of the grid in correspondence of an arched recess. The supporting system includes at least one sustaining element resting on the ground and including at least one protruding body inserted in the first or second seat.

20 Claims, 6 Drawing Sheets

(56) References Cited

U.S. PATENT DOCUMENTS

| | | | | |
|---|---|---|---|---|
| 2007/0204539 | A1* | 9/2007 | Owen | E04F 15/02452 52/263 |
| 2008/0105172 | A1* | 5/2008 | Repasky | E04D 11/007 108/144.11 |
| 2009/0145057 | A1* | 6/2009 | Tsukada | E04F 15/0247 52/126.6 |
| 2010/0257796 | A1* | 10/2010 | Bertke | E04F 11/1812 52/263 |
| 2011/0232208 | A1* | 9/2011 | Tabibnia | E04F 15/02452 52/126.6 |

* cited by examiner

SUPPORTING SYSTEM FOR ABOVE-GROUND FLOORING

The present invention refers, in general, to a supporting system for raised floorings. More particularly, the present invention refers to a supporting system that is particularly easy to use.

The raised floorings are systems of suspended flooring in which the walkable area rests on a structure that is raised off the ground so that an inspectable technical space, for example usable for the passage of cables, is obtained between the ground and the walking surface.

As is known, there are various types of raised floorings that differ from one another in the system utilized for their realization, the bottom on which the floorings are laid and the conformation of the supporting elements utilized for the laying of the floorings.

In particular, the known supporting elements, utilized for the laying of the raised floorings, usually include columns that rest on the ground and support, directly or indirectly, the elements forming the flooring and the walking surface, for example square or rectangular tiles.

Said columns support each tile along the relative perimeter since the space covered by the tile must be inspectable.

Alternatively, there are guides resting on the columns and forming frames on which the tiles rest.

Accordingly, the tiles are laid on guides or columns along their perimeter by means of suction cups or other devices.

In case of breakage of a tile, a dangerous hole is formed in the floor.

Besides, the structure of the support bearing the tiles is at first built by positioning all the columns that are adjustable in height independently to obtain a support at the desired level. Then, the guides are positioned and the tiles are supported.

The laying of the guides is performed starting from a side of the room and proceeding to the opposite side and their arrangement requires an inverse intervention, which complicates the disassembly, or an intervention in different points of the flooring which are not near the side on which the laying has been finished. Indeed, the maintenance of the guides requires that the tiles are lifted starting from where the laying has been completed.

Said process of assembly, adjustment and laying is, therefore, long and laborious.

Accordingly, an aim of the invention is to provide a supporting system for raised floorings in order to overcome the problems of the prior art.

Another aim of the invention is to provide a supporting system for raised floorings at low costs and easy to use.

Another aim of the invention is to provide a supporting system for raised floorings which allows flexibility of use and is robust and stable.

Another aim of the invention is to provide a supporting system for raised floorings which ensures a high safety in case of breakage of one or more tiles in the raised flooring.

All the above-mentioned aims and still others are achieved according to the invention by a supporting system for at least one tile to obtain floorings raised with respect to a reference ground, said supporting system comprising a grid having at least three sides defining the perimeter of the grid and a supporting surface on which the tile can rest.

In particular, the supporting system is characterized in that at least one first seat formed within the perimeter of the grid and at least one second seat formed along the perimeter of the grid are comprised in the grid.

Preferably, at least one sustaining element is comprised and is adapted to rest on the ground and includes at least one protruding body adapted to be inserted in the at least one first seat or the at least one second seat.

Through this configuration it is possible to provide supporting elements for the grid which are positioned in correspondence of the perimeter or within the perimeter itself or in both positions depending on the conformation of the ground.

Advantageously, the first seat may comprise a circular seat and at least one arched seat, said circular seat being communicating laterally with the one or more arched seats. In addition, the second seat may comprise a single arched seat.

Besides, the sustaining element may comprise a supporting element with a body connected laterally to the protruding body, which may inserted in the arched seat or the single arched seat.

Advantageously, the supporting element may comprise four protruding bodies arranged around the body at 90 degrees from each other. Four arched seats, arranged at 90 degrees from each other, may be connected laterally to each circular seat so that the supporting element may be inserted in the circular seat and the four protruding bodies may be inserted in the four arched seats.

In this way, the supporting element is engaged perfectly in the desired circular seat.

Advantageously, the sustaining element may comprise a leg which is threaded externally and a thread may be formed on the inner cylindrical surface of the body so that the leg may be screwed or unscrewed in the body.

Furthermore, a foot may be comprised which rests on the ground and on which the leg rests, a receiving hole being formed in said foot; said leg may be provided with a pin on the lower part, said pin being adapted to be inserted in the receiving hole. In this way, it is possible to obtain a coupling between leg and foot allowing also an oscillation of the leg itself relative to the foot so that the sustaining element may adapt to the ground conformations.

Advantageously, the receiving hole may communicate with two opposite lateral openings and two opposite wings may protrude from said pin and are adapted to be received in the two lateral openings. In this way, it is possible to rotate the leg and screw or unscrew the leg in the supporting element by rotating the foot.

In addition, the leg may have a cylindrical structure which is empty internally and is holed on the lower part, and the receiving hole for the foot may be a through hole so as to allow eventual liquids to pass through leg and foot.

Advantageously, the grid may comprise four sides which are orthogonal to each other and form four corners, an arched recess being formed in correspondence of at least one corner. A single arched seat is formed in correspondence of said arched recess.

In this way, the supporting element may support four different grids. It is sufficient to dispose the supporting element at an angle of each of said grids.

Besides, each of the four protruding bodies may be connected to the body through a connecting element lower than the protruding body so that said connecting element supports the edges of the arched seat or the single arched seat.

Further features and details of the invention will be better understood from the following specification, which is provided by way of a non-limiting example, as well as from the annexed drawings, wherein.

Figure 2:
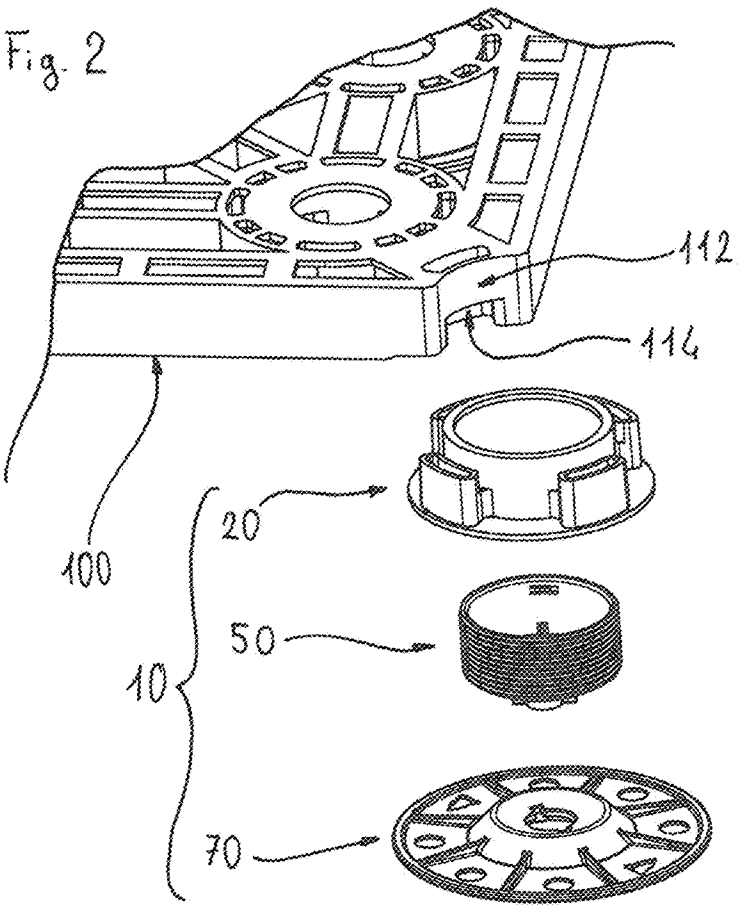
FIG. 2 is a view of a detail, denoted by A in FIG. 1, of the supporting system shown in FIG. 1, namely, the sustaining element represented exploded.

With reference to the annexed drawings, in particular FIGS. 1 to 5, number 1 denotes a supporting system for raised floorings comprising one or more sustaining elements 10 and a grid 100.

The sustaining element 10 includes a supporting element 20, a leg 50 and a foot 70, coupled together as described below.

Figure 6:
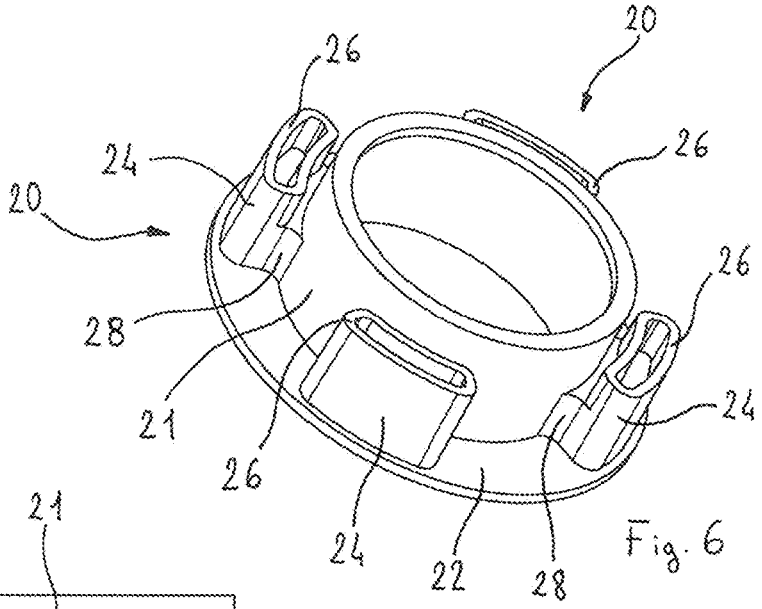
FIGS. 6 to 8 are axonometric views of a first component of the supporting system according to the invention, namely, a supporting element being part of a sustaining element.
Figure 7:
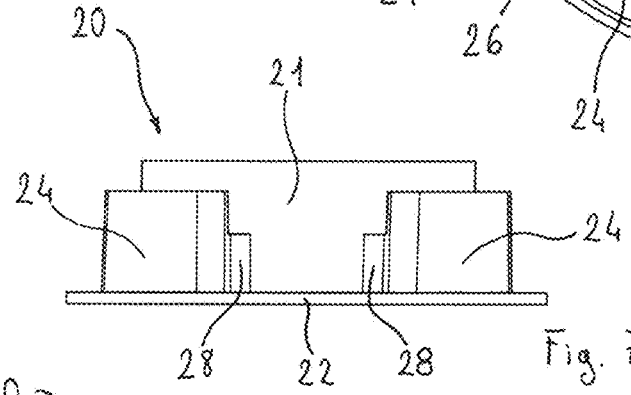
Figure 8:
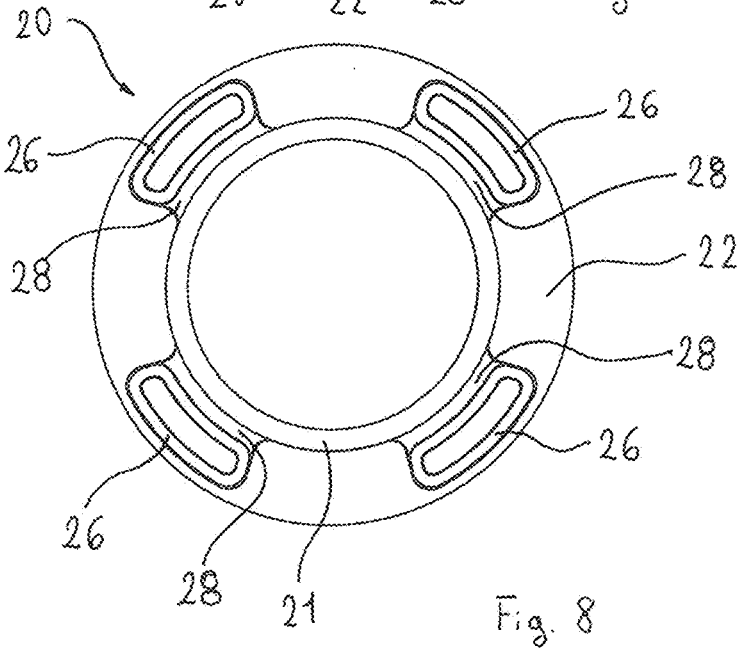
Figure 9:
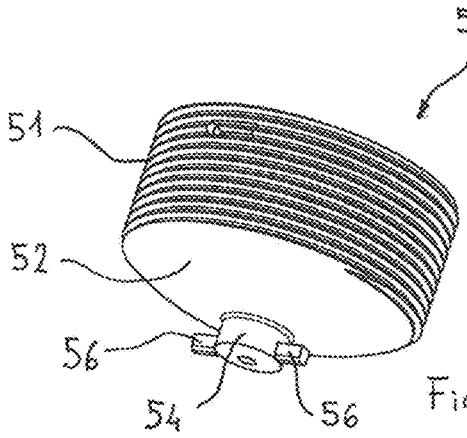
FIGS. 9 to 12 are axonometric views of a second component of the supporting system according to the invention, namely, a leg of a sustaining element.
Figure 11:
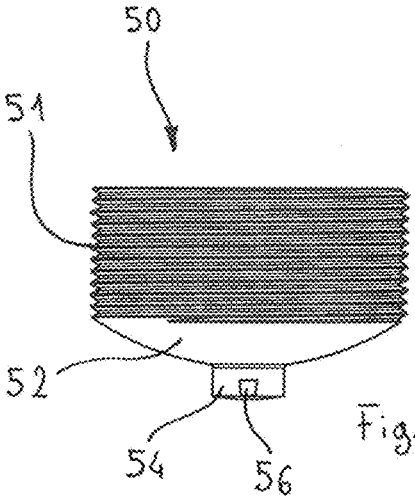

As visible in FIGS. 6 to 8, the supporting element 20 includes a body 21 which is substantially cylindrical, hollow, and internally threaded and which develops in the direction of its central axis.

A shelf 22 protruding from the lower end of the body 21 develops along the entire circular perimeter of the body 21 since the shelf 22 has a circular shape.

Four arched teeth 24 protrude from the shelf 22 vertically and have an upper defined profile 26 and are connected through a respective connecting element 28 to the body 21.

The four teeth 24 are disposed on the shelf 22 at regular angular intervals of 90 degrees.

As visible in FIGS. 9 to 12, the leg 50 includes a stem 51 which is substantially cylindrical, hollow, and externally threaded and which develops according to its central axis. The external thread of the stem 51 is shaped to mate with the internal thread of the body 21 of the supporting element 20.

A cup 52 and a cylindrical pin 54 protrude from the lower end of the stem 51. Two wings 56 protrude from the pin 54.

Figure 10:
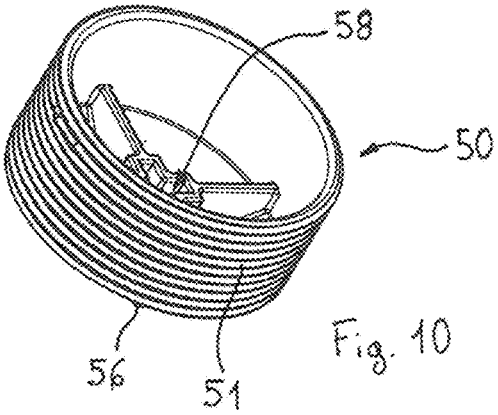
Figure 12:
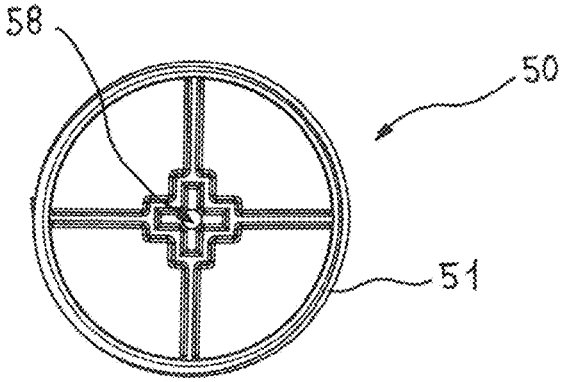
Figure 13:
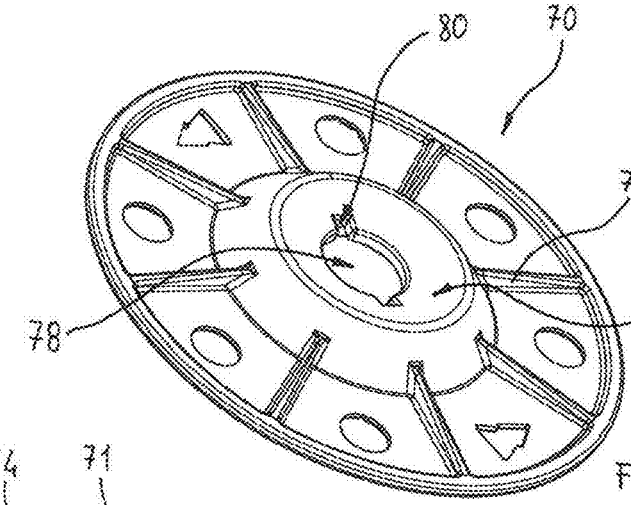
FIGS. 13 to 16 are axonometric views of a third component of the supporting system according to the invention, namely, a foot being part of a sustaining element.
Figure 14:
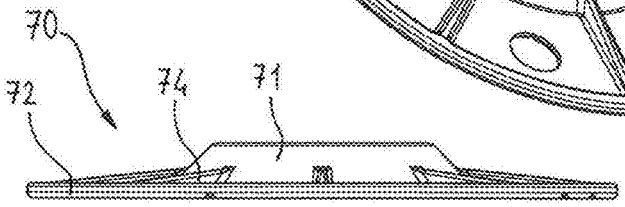
Figure 15:
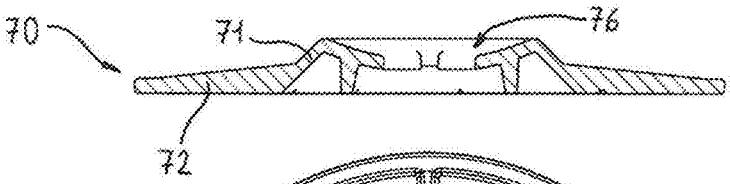
Figure 16:
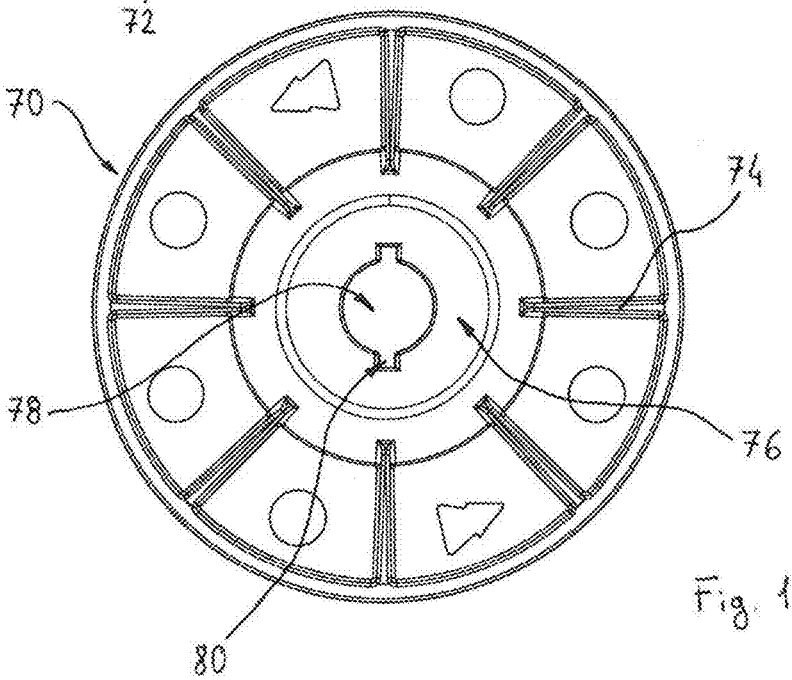

As visible in FIGS. 10 and 12, a cross-shaped cavity 58 is formed on the internal bottom of the stem 51 and ends with a through hole to allow the eventual passage of fluids or other through the leg 50.

As visible in FIGS. 13 to 16, the foot 70 has a discoid shape and includes a frustum-conical body 71 which forms a single body with a disk 72. Besides, the frustum-conical body 71 and the disk 72 are connected by means of eight ribs 72, only one of them being shown in the figures.

A cavity 76 is formed inside the frustum-conical body 71. A through hole 78 is formed in the center of the cavity and has two openings 80, specular to each other, only one of them being visible in the figure.

The hole 78 and the openings 80 are shaped so as to receive the pin 54 and the wings 56 of the leg 50. The hole 78 may have a diameter greater than the diameter of the pin 54 so as to obtain a coupling with clearance and allow a relative inclination between the leg 50 and the foot 70. Through this coupling with clearance it is thus possible to allow a relative inclination between leg 50 and foot 70 while the sustaining function is ensured by the support of the cup 52 into the cavity 76.

Besides, the openings 80 may have dimensions compatible or smaller than the wings 56 so as to allow the insertion of the wings 56 by an operator who forces the wings in such openings, for example with interference fit, so as to avoid an accidental or unwanted uncoupling of the wings.

Figure 18:
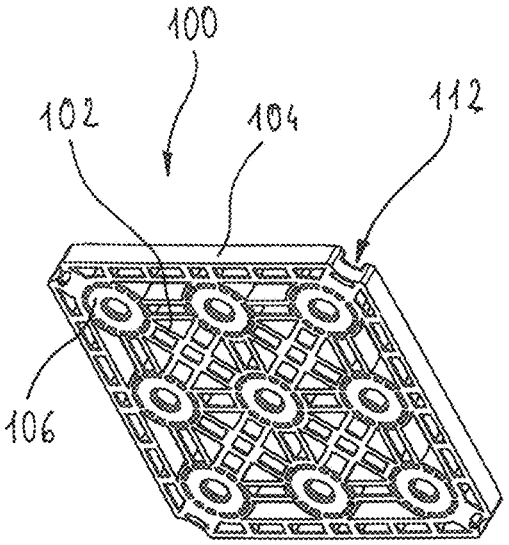
FIGS. 17 to 19 are axonometric views of a component of the supporting system according to the invention, namely, a grid.
Figure 17:
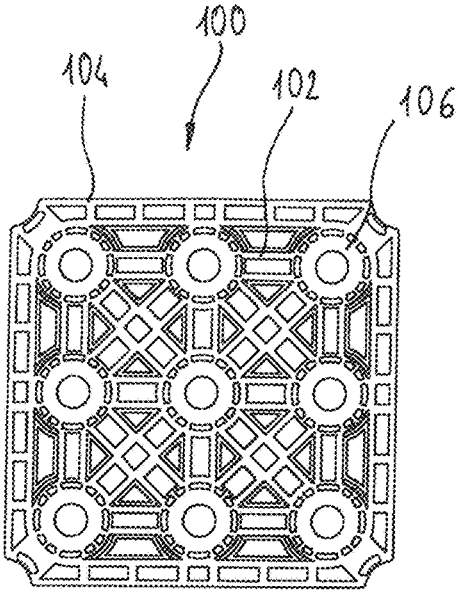
Figure 19:
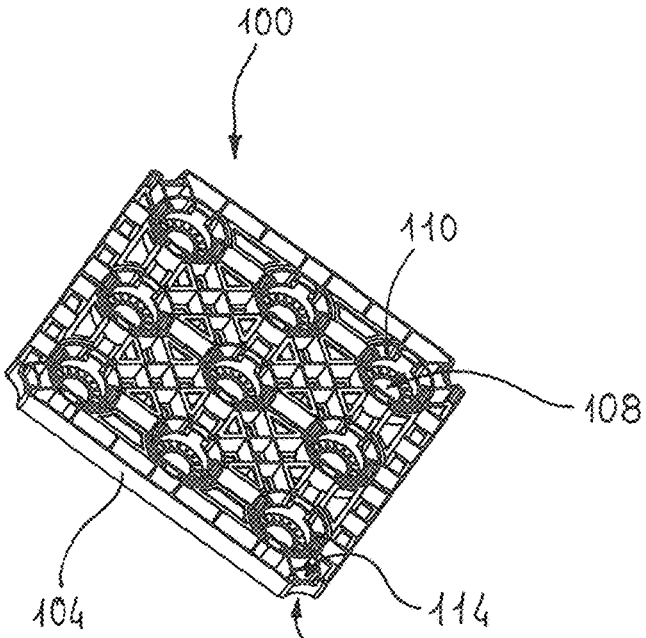

As visible in the FIGS. 17 to 19, a grid 100, symmetric to two cross axes, comprises four side edges 104, only one of them being shown in the figure. These four side edges are similar to one another and are connected through a plurality of ribs 102, intersperced with nine circular bodies 106.

For reasons of clarity, the figures show only a side edge 104, a rib 102 and a circular body 106.

A face of the grid 100 has a flat surface in correspondence of the ribs 102 and circular bodies while the opposite face is more articulated because circular seats 108 are formed in correspondence of the circular bodies 106.

Figures 3, 4, 5:
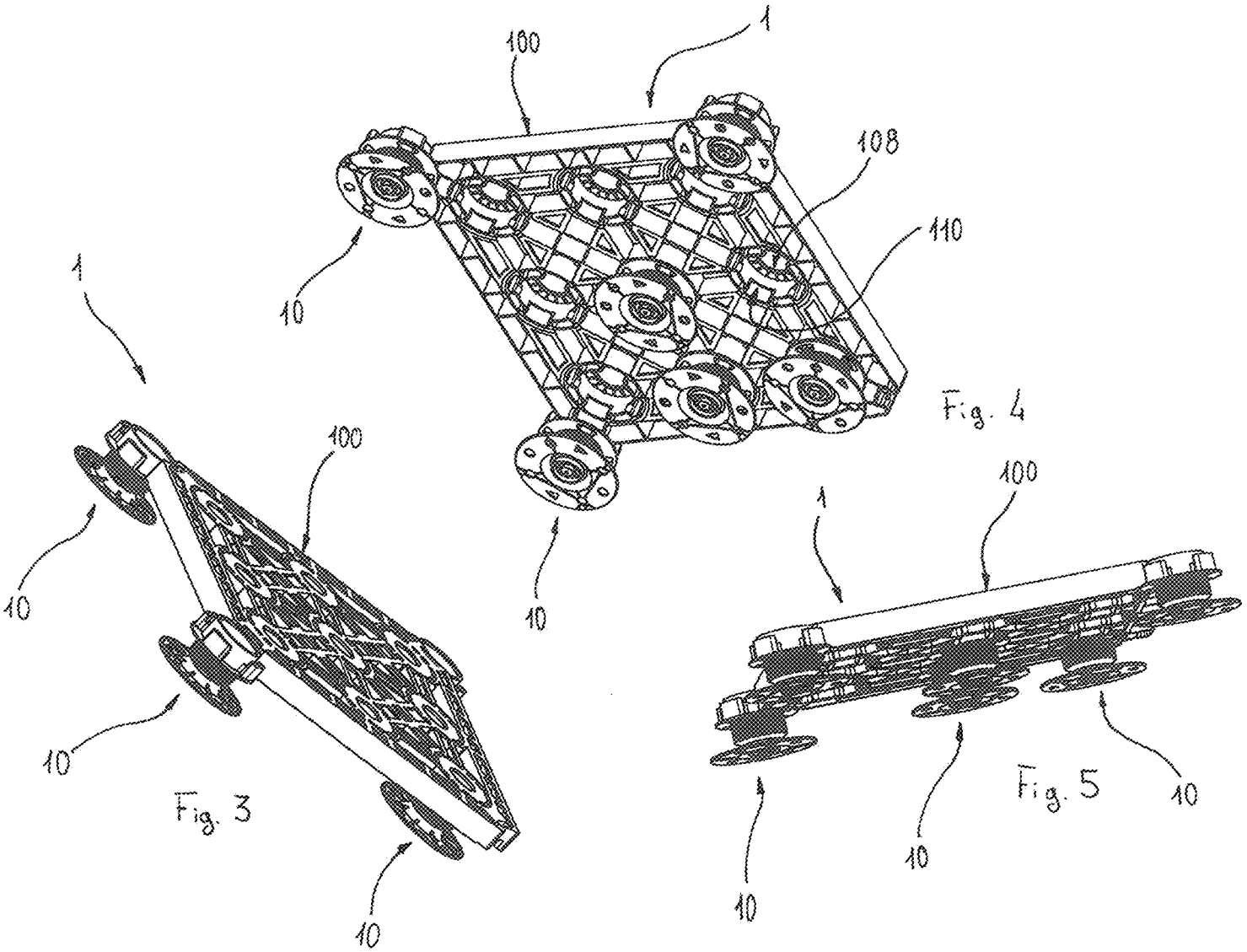
FIGS. 3 to 5 are axonometric views of a supporting system according to the invention.

As visible in FIGS. 4 and 19, four arched seats 110, arranged at 90 degrees to one another, are laterally connected to each circular seat 108.

Through this conformation, the body 21 of a supporting element 20 may be received in each circular seat 108 so that the four arched teeth 24 of the same supporting element 20 are received in the four arched seats 110 corresponding to said circular seat 108, respectively.

In addition, an arched recess 112 is formed in each of the four corners of the grid 100, a single arched seat 114 of the same conformation as the arched seats 110 being obtained in the arched recess 112.

Figure 1:
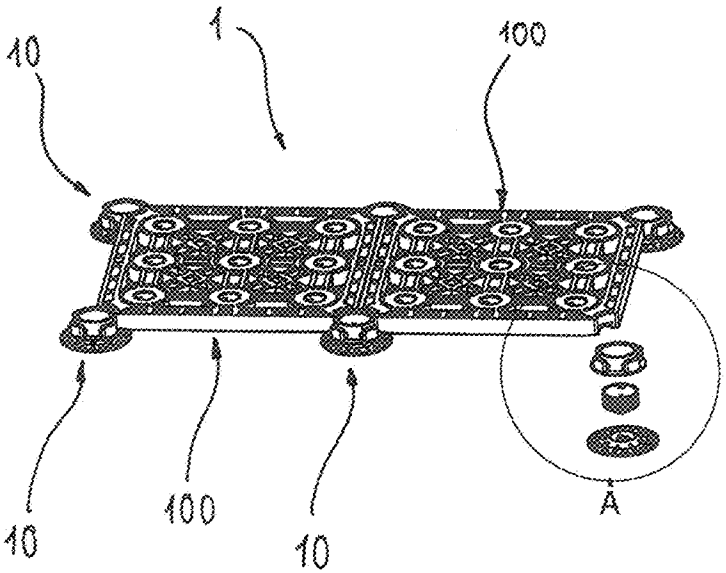
FIG. 1 is an axonometric view of a supporting system according to the invention comprising grids and sustaining elements, a sustaining element being represented exploded.

This configuration allows the coupling of a supporting element 20 also to a corner of the grid 100 by abutting a portion of the relative body 21 on one of the four arched recesses 112 and inserting one of the four teeth in the single arched seat 114 of the arched recess chosen, as shown in FIGS. 1 and 2.

According to the embodiment represented in the figures, the ribs 102 follow a linear path and are disposed so as to connect the nine circular bodies 106 but it is to be intended that grids comprising a different number of ribs with relative arrangement may be carried out.

The supporting system for raised floorings provides for the coupling of more grids 100 by utilizing one or more sustaining elements fixed to the corners of one or more grids 100 as visible in FIG. 1. Once the desired grids supported by the relative sustaining elements 10 have been coupled to one another, a flat surface is obtained which acts as a support for a flooring.

As visible in FIGS. 3 to 5, a grid 100 is coupled with six sustaining elements 10 that are analogous to the sustaining element 10 described above. Thus, each sustaining element 10 consists of a supporting element 20, a leg 50 and a foot 70.

In particular, the stem 51 of the leg 50 is screwed into the body 21 of the supporting element 20 while the wings 56 and the relative pin 54 are received into the openings 80 and hole 78.

The conformation of the sustaining element 10 allows to adjust the height of the grid 100 by screwing and unscrewing the stem 51 in the body 21.

Besides, the sustaining element 10 may be adapted to any irregularities of conformation of the floor on which the supporting system has be laid since it is possible to incline the foot 70 relative to the leg 50 as described above.

Accordingly, the conformation of the sustaining element 10 allows to have an assembly flexibility that the sustaining columns or the guides of the prior art do not allow.

Indeed, the sustaining element itself may be coupled in a safe, stable way into both the circular seats 108 formed between the ribs of the grids and the arched recesses 112 formed at the corners of the grids without the need of using elements having different shapes.

The presence of the grid and ribs allows to position tiles or other materials forming the flooring, which have dimensions and/or shapes different from the grid supporting such tiles or other materials while the prior art requires tiles having univocal dimensions determined by the realization of the guides or the positioning of the columns at the corners of the tiles.

Besides, it is possible to adjust the quantity and/or the position of the elements according to the invention depending on the position of the raised flooring and the load to be supported by the flooring.

The possibility of freely coupling a support with one of the nine circular seats 108 of the grid or one of the four arched recesses 112 allows to make a cut on a grid in order to adapt the grid to the conformation of the installation environment, for example in case a half grid is sufficient to reach a wall.

It is possible to cut the grid easily according to the desired measure, its rigidity and support characteristics being maintained unchanged, and at the same time the grid being maintained raised through the coupling with sustaining elements according to the invention which can be positioned, in respect to the grid, in the most convenient places for the realization and maintenance.

Besides, other variants and embodiments are possible which are to be considered as included in the scope of protection as defined by the following claims.

For example, a grid may comprise a number of circular seats different from that described above and represented in the figures.

Finally, according to a variant of the invention, arched recesses may be provided not only at the corners of the grid, but also along the side edges.

The invention claimed is:

1. Supporting system for at least one tile to obtain floorings raised with respect to a reference ground, said supporting system comprising a grid (100) having at least three sides (104) defining the perimeter of the grid (100) and a supporting surface on which the tile can rest, in which at least one first seat (108, 110) formed within the perimeter of the grid (100) and at least one second seat (114) formed along the perimeter of the grid (100) and corresponding to an arched recess (112) are comprised in the grid, said supporting system comprising at least one sustaining element (10) adapted to rest on the ground and comprising at least one protruding body (24) adapted to be inserted in the at least one first seat (108, 110) or in the at least one second seat (114), wherein the at least one first seat comprises a circular seat (108) and at least one arched seat (110), said circular seat (108) being adjacent the at least one arched seat (110), wherein the at least one second seat comprises a single arched seat (114), and wherein the sustaining element (10) comprises a supporting element (20) with a hollow cylindrical body (21) connected laterally to the at least one protruding body (24) with a connecting element (28), said at least one protruding body (24) being of arched shape and adapted to be inserted in the at least one arched seat (110) or in the single arched seat (114) so that the body (21) is received in the circular seat (108) or so that the body (21) is inserted into and abuts the corresponding arched recess (112).

2. Supporting system according to claim 1, wherein the supporting element (20) comprises four protruding bodies (24) arranged around the body (21) at 90 degrees from each other and wherein four arched seats (110), arranged at 90 degrees from each other, are positioned adjacent to each circular seat (108) so that the supporting element (20) may be inserted in the circular seat (108) and the four protruding bodies (24) may be inserted in the four arched seats (110).

3. Supporting system according to claim 1, wherein the sustaining element (10) comprises a leg (50) which is threaded externally and wherein a thread is formed on the inner cylindrical surface of the body (21), said leg (50) being adapted to be screwed or unscrewed in the body (21).

4. Supporting system according to claim 3, wherein the leg (50) comprises a substantially cylindrical hollow stem (51), threaded externally, a cross-shaped cavity (58) being formed in the bottom of the stem (51), said cross-shaped cavity ending with a through-hole (60) allowing the eventual passage of fluids.

5. Supporting system according to claim 4, wherein a foot (70) is comprised which rests on the ground and on which the leg (50) rests, a receiving hole (78) being formed in said foot (70), said leg (50) being provided with a pin (54) on the lower part, said pin being adapted to be inserted in the receiving hole (78).

6. Supporting system according to claim 5, wherein the foot (70) comprises a body (71) in the shape of a truncated cone inside which a cavity (76) is formed and wherein a cup (52) protrudes from the lower end of the stem (51), said cup (52) resting on the cavity (76).

7. Supporting system according to claim 6, wherein said receiving hole (78) is connected to two opposite lateral openings (80) and wherein two opposite wings (56) protrude from said pin (54) and are adapted to be received in the two lateral openings (80).

8. Supporting system according to claim 6, wherein the leg (50) has a cylindrical structure which is empty internally and is holed on the lower part, and wherein the receiving hole (78) is a through hole.

9. Supporting system according to claim 1, wherein the grid (100) comprises four sides (104) which are orthogonal to each other and form four corners, an arched recess (112) being formed in at least one corner, a single arched seat (114) being formed adjacent said arched recess (112).

10. Supporting system according to claim 2, wherein the sustaining element (10) comprises a leg (50) which is threaded externally and wherein a thread is formed on the inner cylindrical surface of the body (21), said leg (50) being adapted to be screwed or unscrewed in the body (21).

11. Supporting system according to claim 3, wherein a foot (70) is comprised which rests on the ground and on which the leg (50) rests, a receiving hole (78) being formed in said foot (70), said leg (50) being provided with a pin (54) on the lower part, said pin being adapted to be inserted in the receiving hole (78).

12. Supporting system according to claim 10, wherein a foot (70) is comprised which rests on the ground and on which the leg (50) rests, a receiving hole (78) being formed in said foot (70), said leg (50) being provided with a pin (54) on the lower part, said pin being adapted to be inserted in the receiving hole (78).

13. Supporting system according to claim 7, wherein the leg (50) has a cylindrical structure which is empty internally and is holed on the lower part, and wherein the receiving hole (78) is a through hole.

14. Supporting system according to claim 2, wherein the grid (100) comprises four sides (104) which are orthogonal to each other and form four corners, an arched recess (112) being formed in at least one corner, a single arched seat (114) being formed adjacent said arched recess (112).

15. Supporting system according to claim 3, wherein the grid (100) comprises four sides (104) which are orthogonal to each other and form four corners, an arched recess (112) being formed in at least one corner, a single arched seat (114) being formed adjacent said arched recess (112).

16. Supporting system according to claim 4, wherein the grid (100) comprises four sides (104) which are orthogonal to each other and form four corners, an arched recess (112) being formed in at least one corner, a single arched seat (114) being formed adjacent said arched recess (112).

17. Supporting system according to claim 5, wherein the grid (100) comprises four sides (104) which are orthogonal to each other and form four corners, an arched recess (112) being formed in at least one corner, a single arched seat (114) being formed adjacent said arched recess (112).

18. Supporting system according to claim 6, wherein the grid (100) comprises four sides (104) which are orthogonal to each other and form four corners, an arched recess (112) being formed in at least one corner, a single arched seat (114) being formed adjacent said arched recess (112).

19. Supporting system according to claim 7, wherein the grid (100) comprises four sides (104) which are orthogonal to each other and form four corners, an arched recess (112) being formed in at least one corner, a single arched seat (114) being formed adjacent said arched recess (112).

20. Supporting system according to claim 8, wherein the grid (100) comprises four sides (104) which are orthogonal to each other and form four corners, an arched recess (112) being formed in at least one corner, a single arched seat (114) being formed adjacent said arched recess (112).

* * * * *